United States Patent [19]

Heffner

[11] Patent Number: 4,941,708

[45] Date of Patent: Jul. 17, 1990

[54] LIFTING APPARATUS

[76] Inventor: H. Hugh Heffner, Rte. 3, Box 47E, Odessa, Mo. 64076

[21] Appl. No.: 249,670

[22] Filed: Sep. 27, 1988

[51] Int. Cl.[5] ..... A61H 3/04

[52] U.S. Cl. ..... 297/6; 297/339; 297/DIG. 10; 5/88

[58] Field of Search ..... 297/5, 6, 338, 339, 297/DIG. 10; 5/88, 83

[56] References Cited

U.S. PATENT DOCUMENTS

| | | | |
|---|---|---|---|
| 775,520 | 11/1904 | Crigler | 5/83 |
| 2,339,007 | 1/1944 | Gahm | 297/5 |
| 2,350,595 | 6/1944 | Divine | 5/88 |
| 2,629,108 | 2/1953 | Wickey | 5/88 |
| 2,850,075 | 9/1958 | Wilson | 297/339 |
| 3,076,678 | 2/1963 | Griffin | 297/339 |
| 3,539,220 | 11/1970 | Aguilar | 297/DIG. 10 |
| 3,778,052 | 12/1973 | Andow et al. | 297/5 |
| 3,993,349 | 11/1976 | Neufeld et al. | 297/6 |
| 4,345,790 | 8/1982 | Coe | 297/6 |

FOREIGN PATENT DOCUMENTS

| | | | |
|---|---|---|---|
| 850516 | 10/1960 | United Kingdom | 5/88 |

*Primary Examiner*—Francis K. Zugel

*Attorney, Agent, or Firm*—Litman, McMahon & Brown

[57] ABSTRACT

A lifting system comprises a lifting apparatus utilized in cooperation with a conventional walker to lift a person from the floor who, due to age, disease or injury, is not able to lift themselves. The apparatus includes a crank mechanism removably supportable on the arms of the walker and a seat connected to the crank mechanism by a cord such that when the crank mechanism is rotated by a second person, the person to be lifted is raised.

10 Claims, 1 Drawing Sheet

Fig. 1.
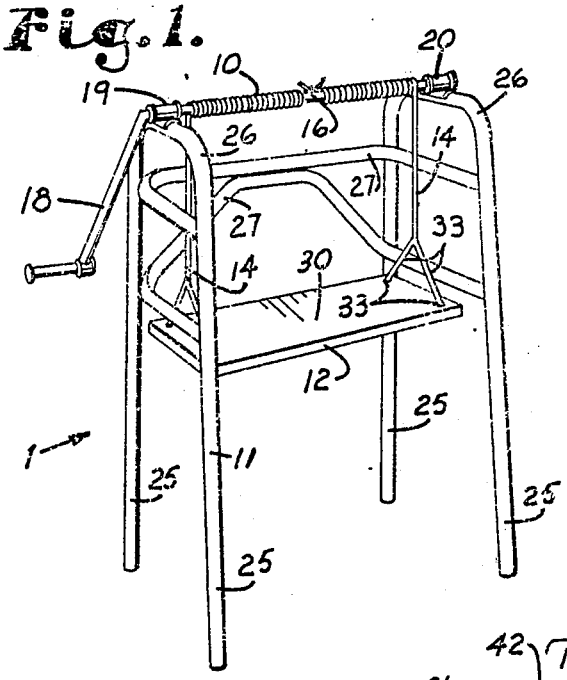
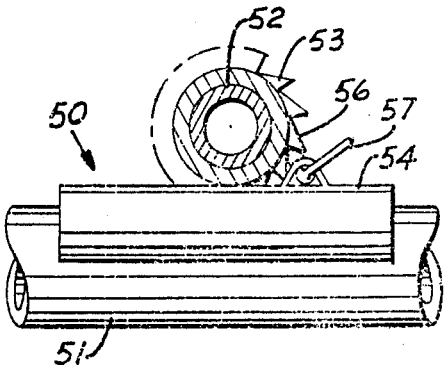
Fig. 5.
Fig. 2.
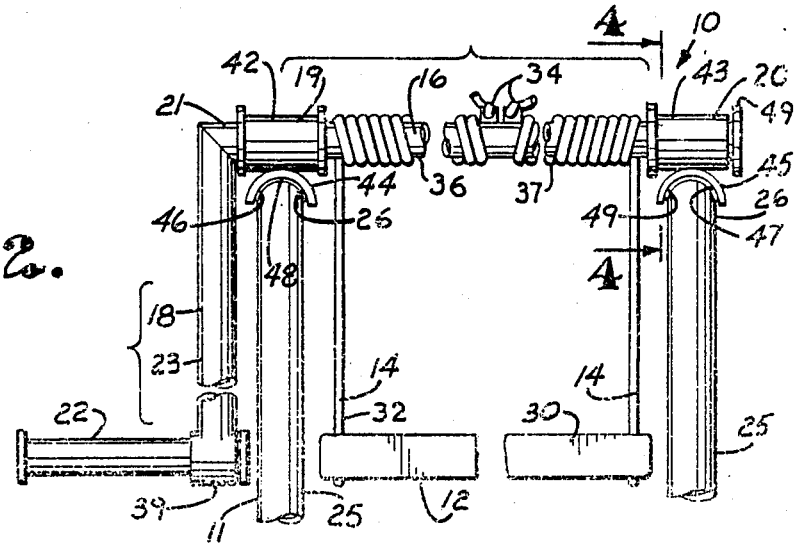
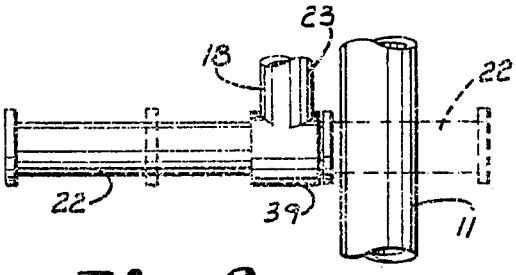
Fig. 3.
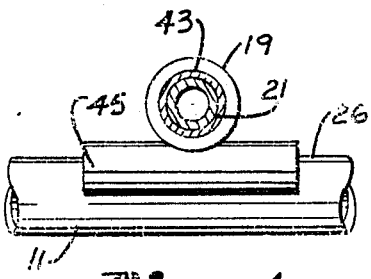
Fig. 4.

LIFTING APPARATUS

BACKGROUND OF THE INVENTION

The present invention relates to devices for lifting fallen invalids or those who, because of arthritis or the like, cannot fully lift themselves although they may be able to walk with the aid of a walker or the like and, in particular, to a lifting device for use in the home and in conjunction with a conventional walker.

Elderly or disabled persons who can walk with some aid from another or with help from devices such as canes and walkers sometimes accidentally fall and do not always have sufficient strength or balance to be able to raise from a prone position on the floor to a sitting or standing position. Sometimes such persons fall at home where the only other persons readily available are of insufficient strength to lift the fallen person. In many such cases, the only person available to assist the fallen person is an elderly spouse, weakened by age, arthritis or the like, but capable of lifting the fallen spouse with a lifting device providing sufficient mechanical advantage is available.

Lifting devices incorporating mechanical advantage for use in hospitals and other institutions are in existence. However, for several reasons, the available lifting devices are not adaptable for use in the home. One reason is the construction and size of the devices used in hospitals. Hospital devices are generally designed to be used in buildings with wide doorways and spaces between furniture. As such, the size, shape and overall construction of such devices prevents easy transference from room to room in a house without disassembly. Hospital type devices are often very cumbersome and there is normally insufficient space in a small house or apartment for storage thereof, nor can many persons afford the costly hospital devices.

Further, the hospital type devices currently in use are not intended for lifting fallen partial invalids. In particular, hospital lifting devices can be generally divided into two categories: those for transferring patients between a bed and a gurney and those for lifting and supporting a portion of the patient's weight while walking. Neither category is particularly adaptable for lifting persons who have fallen to the floor. Finally, the degree of mechanical advantage generally incorporated into devices used in hospitals is not sufficient to enable an elderly person to help lift a person's weight as those devices are intended to be used by hospital personnel.

One other type of invalid lifter in use, also by hospitals, is intended for use in cooperation with a bed so as to raise an invalid to a sitting position from a supine position. This category of lifters have similar shortcomings to the above-mentioned devices when applied to the purpose of the present invention. Namely, the devices for use with beds are not designed to lift persons from the floor and are generally too large and expensive to be used in the home.

It is noted that invalid lifters for use with wheelchairs are also presently in use. Such wheelchair lifters are generally for use by a wheelchair user who has arm strength, but who has lost the use of their legs. With the wheelchair lifter, the fallen person folds out a seat from storage beneath the wheelchair, positions him or herself on the seat, pulls out a pair of handles, and operates the handles to lift him or herself. Limitations of the wheelchair device with respect to the scope of the present invention include: the requirement of a wheelchair; the limited mobility of wheelchairs in close spaces; and that the fallen person must have sufficient arm strength to operate the device.

OBJECTS OF THE INVENTION

Therefore, the objects of the present invention are: to provide a lifting device for use in the spacial confines of home use in a small house, apartment or the like; to provide a lifting device with sufficient mechanical advantage for operation by a person of low strength under poor conditions; to provide such a device sufficient to lift a fallen person to such a height that they are able to sit or stand up; to provide such a device designed to be used with a conventional walker; to provide such a device that may be temporarily placed on a walker and is easily and quickly placed in position on the walker and removed therefrom; to provide such a device that is adjustable to fit most conventional walkers; to provide such a device with a locking means for securing the height of an associated seat in a selected raised position; to provide such a device that is easy to set up for use, take down and store; to provide such a device that is relatively inexpensive to build, requires little space to store, and that may be easily moved to any room of a house; and to provide such a device which is particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 a perspective view of an invalid lifting apparatus in accordance with the present invention in conjunction with a walker.

FIG. 2 is an enlarged and fragmentary front elevational view of the apparatus and walker.

FIG. 3 is an enlarged and fragmentary front elevational view of the apparatus showing a crank handle thereof in a crankable position and showing, in phantom lines, the crank handle in a locking position.

FIG. 4 is an enlarged and fragmentary cross-sectional view of the apparatus taken along line 4—4 of FIG. 2.

FIG. 5 is a fragmentary cross-sectional view of a modified apparatus, showing an alternative ratchet and pawl locking means.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an invalid lifting system in accordance with the present invention. The lifting system 1 includes a lifting apparatus 10 and an invalid walker 11. The lifting apparatus 10 generally comprises a seat 12 adapted to receive a person for lifting, cord means such as illustrated lifting cords 14 connecting the seat 12 with a take-up reel 16 around which the cords 14 are wound as the seat 12 is lifted, crank means such as illustrated crank 18 connected to and adapted to rotate the take-up reel 16 providing sufficient mechanical advantage to raise a person and securing or connecting means such as illustrated sleeving and connecting members 19 and 20 for rotatably mounting the reel 16 on the walker 12. The crank 18 further includes a shaft 21, a crank handle 22 and a crank arm 23.

The walker 11 is of a conventional type used by persons who are generally able to walk but who are weak, unstable in balance or the like such that it is difficult for them to walk without support either from another person or by a mechanical device such as the illustrated walker 11.

In general, the walker 11 has four spaced and generally vertical legs 25 ending at a lower end in stubs with pairs of the legs 25 on opposite sides of the walker 11 and at the top thereof being joined by generally horizontal handlebars 26 which normally function as hand holds for a person using the walker 11 to assist in walking. The walker 11 is used for a walking person by holding the handlebars 26 and raising the walker 11, swinging the walker 11 forward, and then placing the walker 11 down on a floor forward of its original position. The user then steps forward behind the walker 11 while using it for support and balance. Braces 27 and 28 encircle three sides of the walker 11 and are attached to the legs 25 so as to stabilize the walker 11 without interfering with the user thereof and form a relatively stable three sided enclosure. When used as a walker, a user positions themself between the legs 25 with the braces 27 and 28 in front and to the sides of the user who grasps the handlebars 26, lifts the walker 11 to move same forward, then places it down and moves themself forward.

The seat 12 is swingable and normally provides a horizontally aligned planar surface 30. The seat 12 is constructed of rigid material in the shape of a rectangle. To maintain horizontal alignment, the seat 12 is attached to segments 32 of the lifting cords 14 at four opposed corners, see FIG. 1, by passing through respective openings 33 in the seat 12. The segments 32 on opposite ends of the seat 12 converge to form a single cord 14 thereabove. The lifting cords 14 are constructed of flexible material sufficient in strength to support a person. The cords 14 are sufficiently long to permit the seat 12 to be placed on the floor when the apparatus 10 is in position on the walker 11. Each cord 14 is independently fastened to an associated eyelet 34 located on and secured to approximately the middle of the take-up reel 16.

The take-up reel 16 of the illustrated embodiment is integral with and coaxial with the crank shaft 21, although it is foreseen that the reel 16 may be separate from the shaft 21 or that independent reels could be provided for each cord 14. The eyelets 34 are located, as shown in FIG. 2, near the center of the reel 16 separating the take-up reel 16 into separate sections 36 and 37 for each respective cord 14. As the crank 18 is rotated so as to take up the cords 14, the lifting cords 14 helically wind around the sections 36 and 37 of the take-up reel 16 in diverging spirals thereby raising the seat 12.

The shaft 21, crank handle 22, and crank arm 23 are constructed of rigid tubular material. As well as being integral with the take-up reel 16, the shaft 21 has a longitudinal axis of rotation about which the shaft 21 and reel 16 rotate, thereby transferring force from the crank arm 23 to the lifting cords 14. The shaft 21 is sufficiently long to span the distance between the walker handlebars 26, such as that shown in FIG. 1. The shaft 21 and associated reel 16 are sufficiently strong to support the weight of a person without significant deflection.

Force to rotate the shaft 21 is applied at the crank handle 22. The crank handle 22 is connected to the shaft 21 by the crank arm 23. The crank arm 23 is of sufficient length so that the ratio of the crank arm length to the shaft radius (in particular, the radius about which the cords 14 wrap) provides sufficient mechanical advantage for one person of relatively low strength to lift a second person. The crank arm 23 is connected to the shaft 21 at approximately a 90 degree angle and near whereat the lifting apparatus 10 mounts on one side of the walker 11 so as to present a relatively low profile and so as to allow the lifting system 1 to be used in narrow confines when necessary.

In the present embodiment, the crank handle 22 is axially slidably received in the end of the crank arm 23, opposite the shaft 21. In particular, a bushing 39 is used to connect the crank handle 22 and crank arm 23. The bushing 39 permits force from the crank handle 22 to be transferred in the direction of rotation while the crank handle 22 remains extended axially outward relative to the walker 11 in a cranking position, see solid lines in FIG. 3. The crank handle 22 is also movable to a locked position wherein the handle 22 interferingly engages one of the walker legs 25 upon rotation, thereby preventing rotation and fixing the position of the seat 12. To prevent the handle 22 from sliding completely through the bushing 39, opposite ends of the handle 22 are flanged.

The shaft 21 is rotatably and removably mounted on the walker handle bars 26 by mounting means, such as the illustrated sleeving and connector members 19 and 20 respectively positioned near opposed ends of the shaft 21. The members 19 and 20 each include a sleeve or bushing 42 and 43 respectfully received around the shaft 21.

Fixedly attached to each of the bushings 42 and 43 is a semi-cylindrical or half-annular support 44 and 45 respectfully. Each of the supports 44 and 45 are secured by welding or the like to a respective bushing 42 and 43 such that the longitudinal axis of each of the supports is perpendicular to a longitudinal axis of a respective bushing 42 and 43. The supports 44 and 45 each have a semicircular surface 46 and 47 respectively which is opposite the respective bushing 42 and 43 and which is shaped to receive one of the walker handlebars 26. Attached to each surface 46 and 47 is a pad 48 and 49 having a relatively high coefficient of friction to resist axial slippage of the supports 44 and 45 along the walker handlebars 26 during lifting. Facing ends of the bushings 42 and 43 are flanged to prevent the cords 14 from riding up and over the bushings 42 and 43. Likewise, a distal end 49 of the shaft 21 is flanged to prevent the bushing 43 from sliding off the end of the shaft 21 during use.

The shaft bushings 42 and 43 permit the shaft 21 to be freely rotated relative to the walker 11 and are axially slidable so as to be adjustable along the axis of the shaft 21 and thereby allow the supports 44 and 45 to be adjusted to fit walkers 11 having handlebars of a different spacing. The supports 44 and 45 are constructed of rigid material having the shape of a cylindrical segment formed by splitting a tube or cylinder with a plane passing through the longitudinal axis thereof.

In use, a person to be lifted is brought to a sitting position on the floor either through their own efforts or by help from a second person and is then likewise placed on the seat 12 while same is in the lowered position. The crank 18 is then operated by the second person and the seat 12 with the person to be lifted is raised to a selected raised position. At this time, the person being lifted can come to a standing position on their own or if they need assistance, the second person may lock the crank 18 by pushing the crank handle 22 inward so that it abuts against one of the walker legs 25 (see phantom lines in FIG. 3) at which time, the second person can help the other person up. After use, the apparatus 10 is removed from the walker 11 to then allow a person to use the walker 11 to assist in walking.

Partially shown in FIG. 5 is a modified embodiment of a lifting system 50 according to the present invention, which is similar to the system 1 except in the manner in which an associated crank can be locked.

In particular, shown in FIG. 5, is a cross-sectional view of a shaft 52 which is similar to the shaft 21. About the shaft 52 is a sleeve 53 in which the shaft 52 rotates attached to a support 54. In this embodiment, a ratchet and pawl mechanism 56 is attached partly to the shaft 52 and partly to the support 54 such that rotation of the shaft 52 operates the mechanism 56. In this manner, the mechanism 56 locks the lifting system 50 in a new raised position with each rotation of the shaft 52 in a direction to raise the person to be lifted, but to lower the system 50, a release 57 must be manipulated on the mechanism 56.

It is foreseen that, although lifting apparatus of the type disclosed herein is especially well suited for a conventional walker, a frame similar to a walker could be used in place thereof within the scope of the invention.

It is to be understood that while certain forms of the present invention have been illustrated and described herein, it is not to be limited to the specific forms or arrangement of parts described and shown.

What is claimed and desired to be secured by letters patent is as follows:

1. A lifting system adapted to raise a person from the floor to a standing or raised sitting position; said system comprising:

(a) a walker having a plurality of legs and a pair of generally hroizontal and parallel handles adapted to be grasped by a person when using said walker to walk; said walker having a lifting configuration wherein said system may be used to raise a person and a walker configuration wherein the walker may be used by a person to assist in walking;

(b) a lifting apparatus usable with said walker; said apparatus relatively easily being positioned on said walker such that said walker is in the lifting configuration thereof and removed from said walker such that said walker is in the walker configuration thereof; said lifting apparatus, when in use with said walker, having:

(1) a shaft extending between said walker handles;

(2) connecting means including a semi-circular member for selectively positioning and holding said shaft on said handles while allowing rotation of said shaft;

(3) crank means for selectively rotating said shaft;

(4) a seat positioned to hang between said walker handles and being adapted to support the person to be raised; said seat having a lowered position and a plurality of raised positions; and (5) flexible cord means suspending said seat from said shaft; said cord means winding about said shaft upon rotation of said shaft by said crank means so as to draw said seat toward said shaft, thereby moving said seat from the lowered position to one of the raised positions thereof.

2. The apparatus according to claim 1 including:

(a) locking means to prevent rotation of said shaft against the weight of a person being lifted by said apparatus and thereby lock said seat in a preselected raised position.

3. The apparatus according to claim 2 wherein:

(a) said crank means includes a crank having a crank handle.

4. The apparatus according to claim 3 wherein:

(a) said crank handle is axially slidable relative to a remainder of said crank and has a cranking position and a locked position; when in said locked position, said handle being positioned to interferingly engage a leg of the walker.

5. The apparatus according to claim 2 wherein:

(a) said locking means comprises a ratchet and pawl mechanism cooperating between said mounting means and said shaft to allow rotation of said shaft to be selectively locked relative to said mounting means.

6. The apparatus according to claim 1 wherein:

(a) said cord means comprise a pair of cords; each of said pair of cords being attached at a first end thereof to an end of said seat respectively and both of said cords being attached at second ends thereof to said shaft.

7. The apparatus according to claim 6 wherein:

(a) said crank means comprises a crank having a crank arm perpendicularly attached to said shaft and a crank handle perpendicularly attached to said crank arm; and (b) said shaft is integral and rotates about a single axis, such that rotation of said shaft winds both cords simultaneously and generally equally about said shaft.

8. The apparatus according to claim 1 wherein:

(a) said connecting means further comprises a pair of supports rotatably mounted at opposite ends of said shaft and adapted to be securely positioned on generally horizontal handlebars of the walker, such that said shaft extends between said handlebars when said apparatus is in use with said walker.

9. The apparatus according to claim 8 wherein:

(a) each of said supports include a sleeve slidably mounted on said shaft so as to allow rotation of shaft relative to said sleeves and said semiannular member snugly positionable over one handlebar of the walker and attached to said sleeve such that a longitudinal axis of said sleeve is perpendicular to a longitudinal axis of an associated semi-annular member.

10. A lifting system adapted to raise a person from the floor to a standing or raised sitting position; said system comprising:

(a) a walker having a plurality of stub legs and a pair of generally horizontal and parallel handlebars adapted to be grasped by a person using said walker to walk; said walker having a lifting configuration wherein said system may be used to raise a person and a walker configuration wherein said walker may be used by a person to assist in walking;

(b) a lifting apparatus usable with said walker; said apparatus being selectively positionable on said walker for lifting such that said walker is then in the lifting configuration thereof and relatively easily removed from said walker such that said walker is then in the walker configuration thereof; said lifting apparatus, when in use with said walker, having:

(1) a shaft extending between said walker handlebars;

(2) connecting means for selectively holding said shaft on said handlebars while allowing rotation of said shaft; said connecting means including sleeves rotatably mounting said shaft and a semi-annular member attached to each sleeve and positionable on a respective handlebar by simply setting said member on a respective handlebar, said members thereafter operably supporting said shaft;

(3) a crank attached to said shaft and allowing selective rotation of said shaft;

(4) a seat adapted to support the person to be raised; said seat having a lowered position and a plurality of raised positions; and (5) a pair of flexible cords suspending said seat from said shaft; said cords simultaneously winding about said shaft upon rotation of said shaft by said crank so as to draw said seat toward said shaft, thereby moving said seat from the lowered position to one of the raised positions thereof.

* * * * *